US009517626B2

(12) United States Patent
Chen et al.

(10) Patent No.: US 9,517,626 B2
(45) Date of Patent: Dec. 13, 2016

(54) PRINTED CIRCUIT BOARD FLUID EJECTION APPARATUS

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/770,691

(22) PCT Filed: Dec. 19, 2013

(86) PCT No.: PCT/US2013/076699

§ 371 (c)(1),
(2) Date: Aug. 26, 2015

(87) PCT Pub. No.: WO2014/133660

PCT Pub. Date: Sep. 4, 2014

(65) Prior Publication Data

US 2016/0016404 A1 Jan. 21, 2016

(30) Foreign Application Priority Data

Feb. 28, 2013 (WO) ..... PCT/US2013/028207
Mar. 26, 2013 (WO) ..... PCT/US2013/033865

(51) Int. Cl.
*B41J 2/16* (2006.01)
*B41J 2/14* (2006.01)

(52) U.S. Cl.
CPC ..... *B41J 2/1623* (2013.01); *B41J 2/1404* (2013.01); *B41J 2/14072* (2013.01); *B41J 2/1603* (2013.01); *B41J 2/1628* (2013.01); *B41J 2/1632* (2013.01); *B41J 2202/20* (2013.01)

(58) Field of Classification Search
CPC ..... B41J 2/1433; B41J 2/162; B41J 2/1623
See application file for complete search history.

(56) References Cited

U.S. PATENT DOCUMENTS 4,873,622 A 10/1989 Komuro et al.
6,250,738 B1 * 6/2001 Waller ..... B41J 2/14024 347/13
6,281,914 B1 8/2001 Hiwada et al.
(Continued)

FOREIGN PATENT DOCUMENTS

CN 102470672 A 5/2012
KR 20020025590 4/2002
WO WO-2012023939 2/2012

OTHER PUBLICATIONS

Lindemann, et al.; One Inch Thermal Bubble Jet Printhead with Laser Structured Integrated Polyimide Nozzle Plate; Journal of Microelectromechanical System: Apr. 2007, vol. 16., No. 2., pp. 420-428.

*Primary Examiner* — Bradley Thies
(74) *Attorney, Agent, or Firm* — HP Inc—Patent Department

(57) ABSTRACT

In an example, a fluid ejection apparatus includes a printhead die embedded in a printed circuit board. Fluid may flow to the printhead die through a plunge-cut fluid feed slot in the printed circuit board and into the printhead die.

20 Claims, 11 Drawing Sheets

(56) References Cited

U.S. PATENT DOCUMENTS

| | | | | |
|---|---|---|---|---|
| 6,634,736 | B2 | 10/2003 | Miyakoshi et al. | |
| 6,997,540 | B2 * | 2/2006 | Horvath | B41J 2/14024 347/40 |
| 7,347,533 | B2 | 3/2008 | Elrod et al. | |
| 7,658,467 | B2 | 2/2010 | Silverbrook | |
| 7,862,160 | B2 | 1/2011 | Andrews et al. | |
| 2006/0209110 | A1 | 9/2006 | Vinas et al. | |
| 2010/0132874 | A1 * | 6/2010 | Anderson | B41J 2/14129 156/89.12 |
| 2011/0037808 | A1 * | 2/2011 | Ciminelli | B41J 2/14072 347/50 |
| 2012/0154486 | A1 * | 6/2012 | Anderson | B41J 2/155 347/40 |

* cited by examiner

PRINTED CIRCUIT BOARD FLUID EJECTION APPARATUS

BACKGROUND

Printhead dies in an inkjet pen or print bar may include tiny channels that carry fluid, such as ink, to the ejection chambers. Ink may be distributed from the ink supply to the die channels through passages in a structure that supports the printhead die(s) on the pen or print bar. It may be desirable to shrink the size of each printhead die, for example to reduce the cost of the die and, accordingly, to reduce the cost of the pen or print bar. The use of smaller dies, however, may require changes to the larger structures that support the dies, including the passages that distribute ink to the dies.

BRIEF DESCRIPTION OF THE DRAWINGS

The detailed description section references the drawings, wherein.

Figure 1:
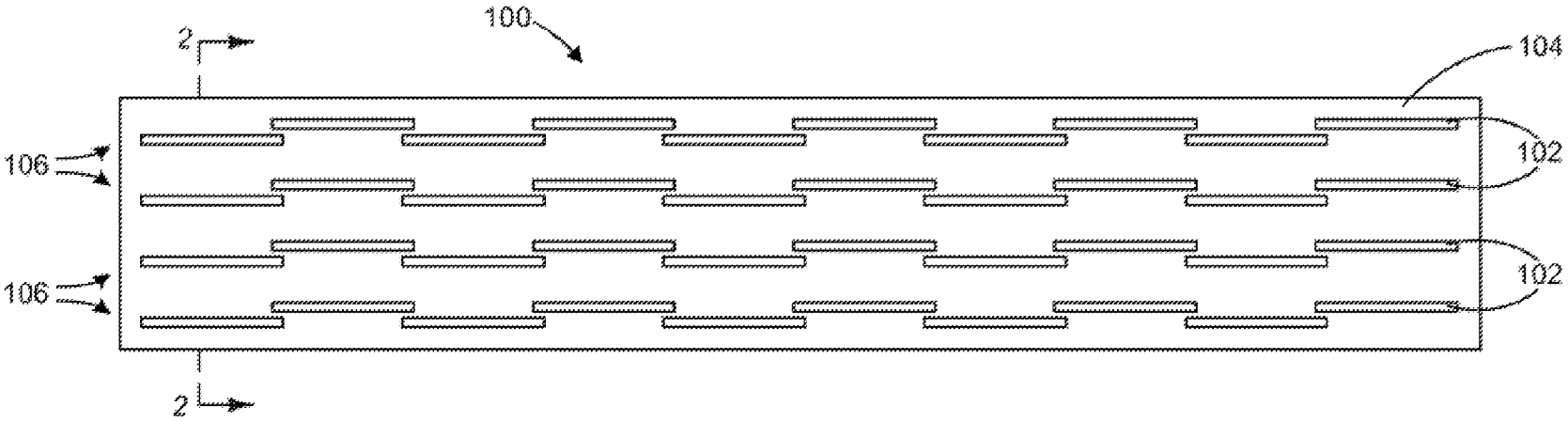
FIGS. 1-5 illustrate an inkjet print bar implementing an example of a fluid ejection apparatus.

all in which various embodiment may-be implemented.

Examples are shown in the drawings and described in detail below. The drawings are not necessarily to scale, and various features and views of the drawings may be shown exaggerated in scale or in schematic for clarity and/or conciseness. The same part numbers may designate the same or similar parts throughout the drawings.

DETAILED DESCRIPTION

Inkjet printers that utilize a substrate wide print bar assembly have been developed to help increase printing speeds and reduce printing costs. Conventional substrate wide print bar assemblies include multiple parts that carry printing fluid from the printing fluid supplies to the small printhead dies from which the printing fluid is elected on to the paper or other print substrate. While reducing the size and spacing of the printhead dies continues to be important for reducing cost, channeling printing fluid from the larger supply components to ever smaller, more tightly spaced dies requires complex flow structures and fabrication processes that can actually increase cost.

Described herein are various implementations of a fluid ejection structure enabling the use of smaller printhead dies and more compact die circuitry to help reduce cost in substrate wide inkjet printers. A printhead structure implementing one example of the new fluid ejection structure may include multiple printhead dies glued or otherwise mounted in openings in a printed circuit board such that drop ejectors of first surfaces of the printhead dies are exposed at a first surface of the printed circuit board. The structure may include plunge-cut fluid feed slot through which fluid may flow to respective ones of the printhead dies, the plunge-cut fluid feed slot extending through a second surface, opposite the first surface, of the printed circuit board and into a second surface, opposite the first surface, of the printhead dies. Conductive pathways in the printed circuit board may connect to electrical terminals on the dies. The printed circuit board in effect grows the size of each printhead die for making fluid and electrical connections and for attaching the printhead dies to other structures, thus enabling the use of smaller dies. The ease with which printed circuit boards can be fabricated and processed may also help simplify the fabrication of page wide print bars and other printhead structures as new, composite structures with built-in printing fluid channels, eliminating the difficulties of forming the printing fluid channels in a substrate.

In various implementations, the fluid ejection structure may not be limited to print bars or other types of printhead structures for inkjet printing, but may be implemented in other devices and for other fluid flow applications. Thus, in one example, the fluid ejection structure may include a micro device embedded in a printed circuit board having fluid feed slots and channels therein through which fluid may flow to the micro device. The micro device, for example, could be an electronic device, a mechanical device, or a microelectromechanical system (MEMS) device. The fluid flow, for example, could be a cooling fluid flow into or onto the micro device or fluid flow into a printhead die or other fluid dispensing micro device.

As used herein, a "printed circuit board" means a non-conductive substrate with conductive pathways for mechanically supporting and electrically connecting to an electronic device and may comprise a stack of a plurality of layers such as, for example, prepreg layers and metal layers (printed circuit board is sometimes abbreviated "PCB"); a "micro device" means a device, such as a printhead die, etc., having one or more exterior dimensions less than or equal to 30 mm; "thin" means a thickness less than or equal to 650 μm; a "sliver" means a thin micro device having a ratio of length to width (L/W) of at least three; a "printhead" end a "printhead die" mean that part of an inkjet printer or other inkjet type dispenser that dispenses fluid from one or more openings. A printhead includes one or more printhead dies. "Printhead" and "printhead die" are not limited to printing with ink and other printing fluids but also include inkjet type dispensing of other fluids and/or for uses other than printing.

Figure 2:
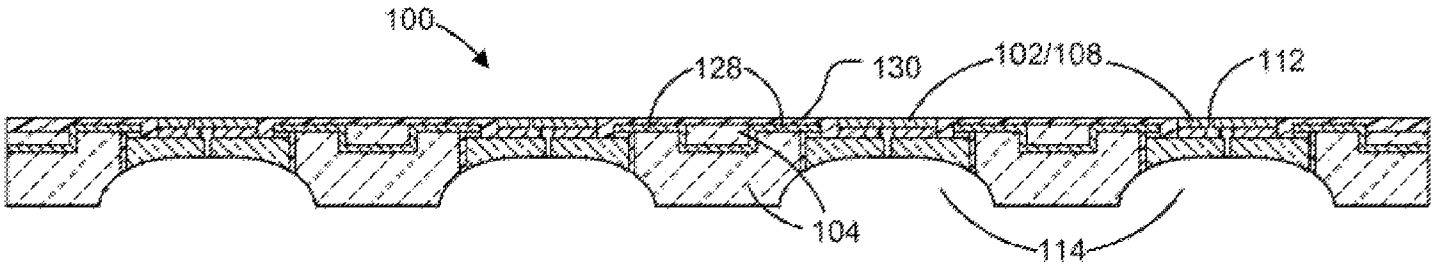
Figure 3:
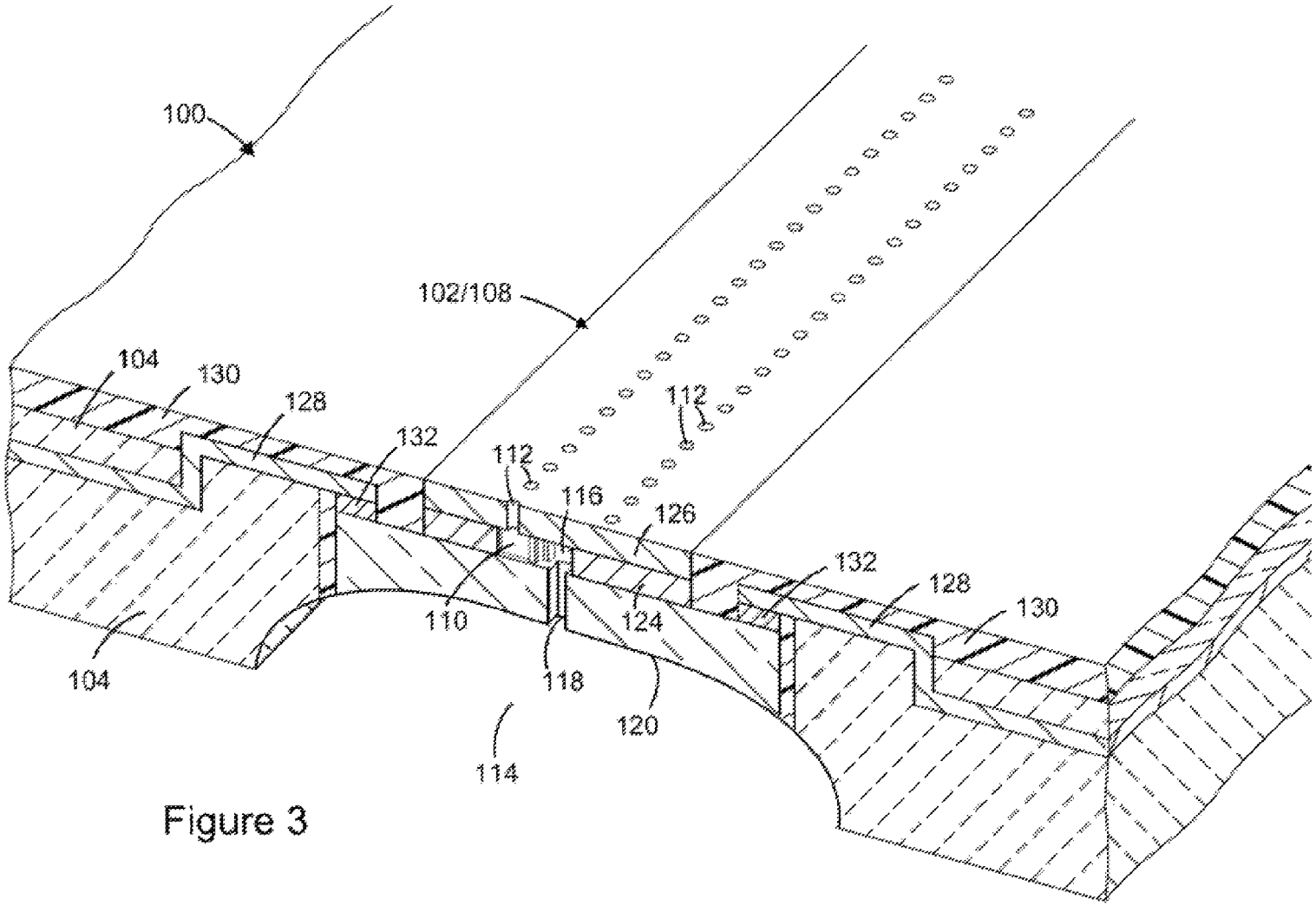
Figure 4:
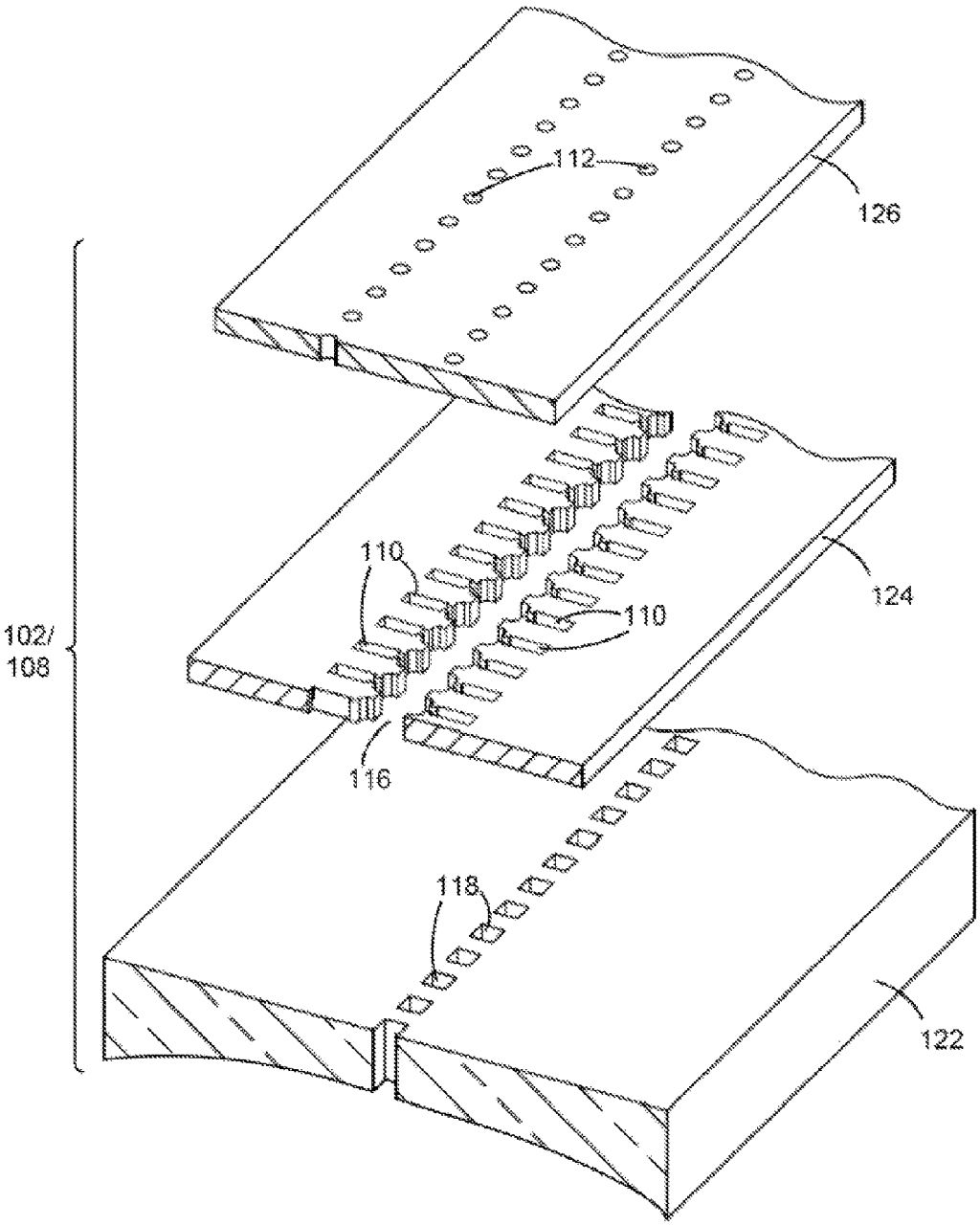
Figure 5:
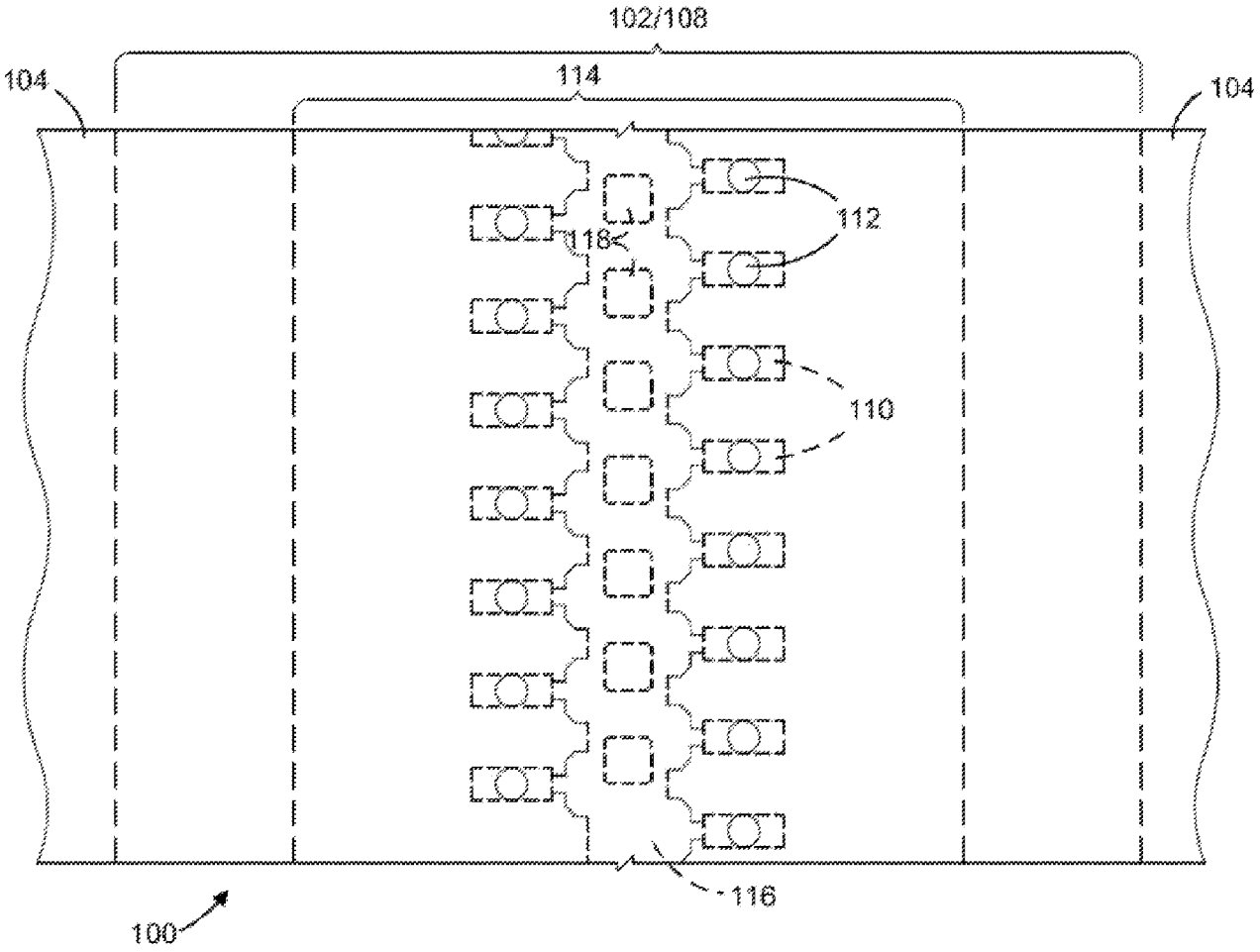

FIGS. 1-5 illustrate an example of a fluid ejection apparatus 100 in which printhead dies are embedded in a printed circuit board with plunge-out fluid feed slots. In this example, fluid ejection apparatus 100 may be configured as an elongated print bar such as might be used in a single pass substrate wide printer. Referring first to FIGS. 1 and 2, printheads 102 may be embedded in an elongated printed circuit board 104 and arranged generally end to end in rows 106 in a staggered configuration in which the printheads 102 in each row overlap another printhead 102 in that row. Although four rows 106 of staggered printheads 102 are shown, for printing four different colors for example, other suitable configurations may be possible. FIGS. 3-5 are detailed views of one of the die slivers 102 shown in FIG. 2.

Referring now to FIGS. 1-5, in the example shown, each printhead 102 may include a single printhead die sliver 108 with two rows of ejection chambers 110 and corresponding drop ejectors 112 through which printing fluid may be ejected from chamber 110. A fluid feed slot/channel 114 in printed circuit board 104 may supply printing fluid to each printhead die sliver 108. Other suitable configurations for each printhead 102 may be possible. For example, more or fewer printhead die slivers 108 may be used with more or fewer ejection chambers 110 and fluid feed slots 114 or larger dies (not slivers) may be used.

Printing fluid may flow into each ejection chamber 110 from a manifold 116 extending lengthwise along each die sliver 108 between the two rows of ejection chambers 110.

Printing fluid may feed into manifold 116 through multiple ports 118 that are connected to a printing fluid feed slot/channel 114 at die surface 120. The idealized representation of a printhead die 106 in FIGS. 1-5 depicts three layers 122, 124, 126 for convenience only to clearly show ejection chambers 110, drop ejectors 112, manifold 116, and ports 118. An actual inkjet printhead die sliver 108 may be a typically complex integrated circuit (IC) structure formed on a silicon substrate 122 with layers and elements not shown in FIGS. 1-5. For example, a thermal ejector element or a piezoelectric ejector element formed (not shown) on substrate 122 at each ejection chamber 110 may be actuated to eject drops or streams of ink or other printing fluid from drop ejectors 112. Conductors 128 covered by a protective layer 130 and attached to electrical terminals 132 on substrate 122 carry electrical signals to ejector and/or other elements of printhead die sliver 108.

FIGS. 6-11 illustrate one example method for making a printhead structure 100 such as the one shown in FIGS. 1-5. FIG. 12 is a flow diagram of the method illustrated in FIGS. 6-11. Although a process for making a printhead structure 100 with printhead dies 108 is shown, the method may be used to form other fluid ejection structures using other micro devices. Also, while only one printhead structure 100 is shown, the method may be used to simultaneously fabricate multiple printhead structures 100. Indeed, one of the advantages of embedding dies 108 in a printed circuit board 104 is the ease with which a print circuit board 104 may be made to different sizes to accommodate individual, group or wafer level fabrication.

Figure 6:
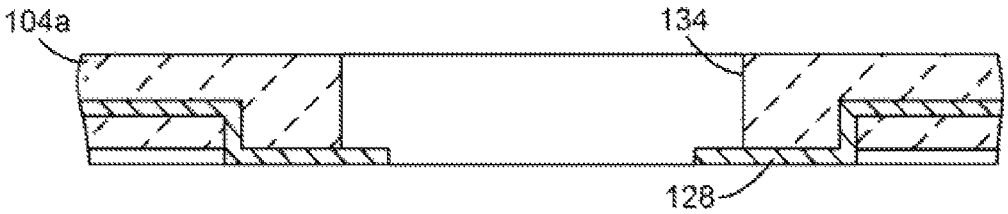
FIGS. 6-12 illustrate an example of a method for making a fluid ejection apparatus.
Figure 7:
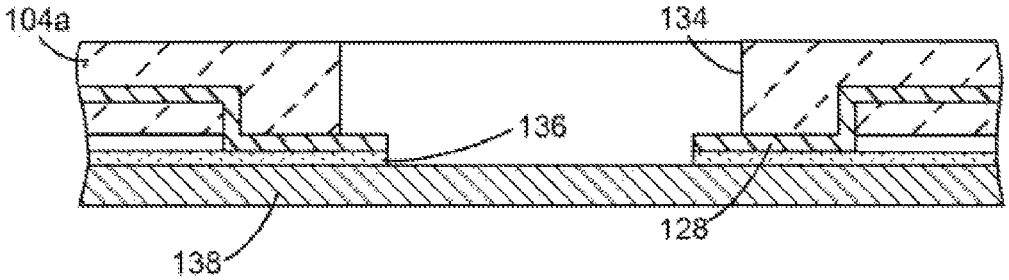

Referring first to FIG. 6, in preparation for receiving a micro device (such as, e.g., a printhead die), an opening 134 is sawn or otherwise formed in a first printed circuit board layer set 104*a* of a printed circuit board and conductors 128 exposed inside the opening 134. In FIG. 7, a patterned die attach film or other suitable adhesive 136 is applied to printed circuit board 104 and a PET (polyethylene terephthalate) film, high-temperature tape, or other suitable barrier 138 applied over die attach film 136 (operation 1202 of FIG. 12). Barrier 138 spanning opening 134 forms a cavity for receiving a printhead die 102 (operation 1204 of FIG. 12) such that a first surface, the top side, of the die 102 faces the barrier 138 and a second surface, the back side, of the die 102 faces away from the barrier 138, as shown in FIG. 8.

Figure 8:
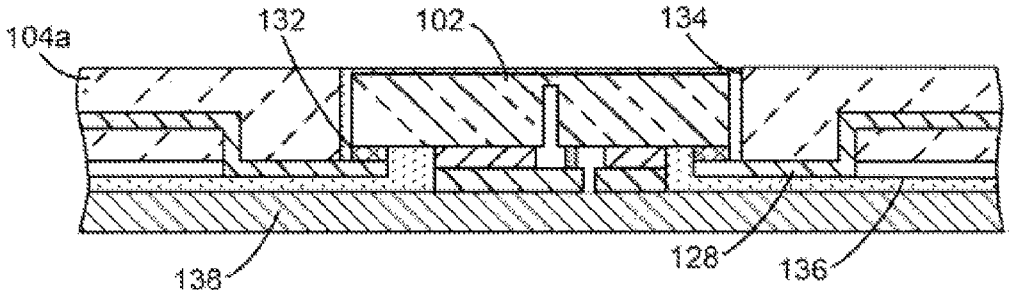

In FIG. 8, PCS conductors 128 are bonded to printhead die terminals 132 (operation 1206 of FIG. 12) and die attach adhesive 136 is flowed into the gaps around printhead die 102 (operation 1208 of FIG. 12). Die attach adhesive 136 forms the glue that holds printhead die 102 in the opening 134. Die attach adhesive 136 also seals the embedded die 102 in the opening 134. Accordingly, although any suitable adhesive may be used for die attach 136, including die attach films commercially available for semiconductor fabrication, the adhesive should resist the corrosive effect, if any, of the ink or other printing fluids.

In one example for bonding and flowing, solder or conductive adhesive is applied to one or both conductors 128 and terminals 132 before assembly and the structure heated after assembly to reflow the solder to bond conductors 128 and terminals 132 and to flow (or wick) adhesive 136 into the gaps around printhead die 102 as shown in FIG. 8.

Figure 9:
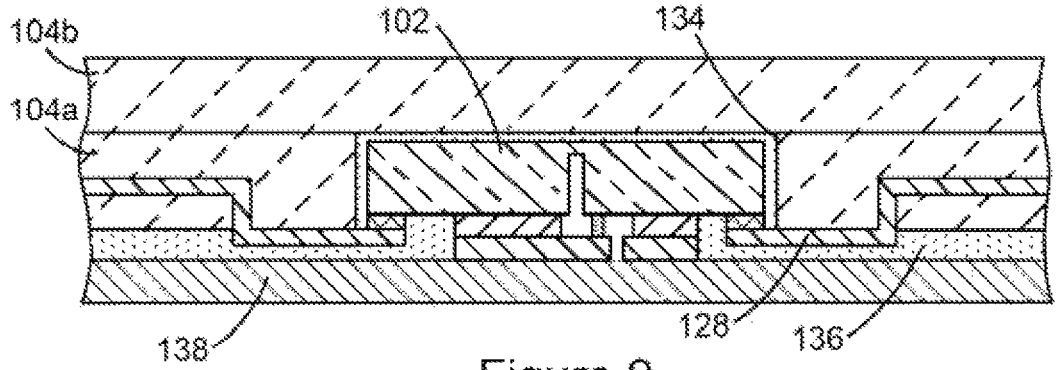
Figure 10:
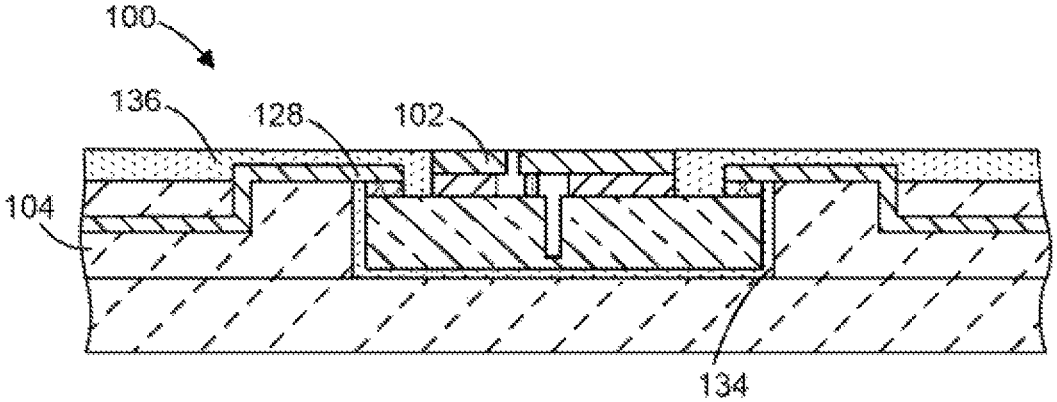

In FIG. 9, a second printed circuit board layer set 104*b* is coupled to the first printed circuit board layer set 104*b* (operation 1210 of FIG. 12). As shown, the second printed circuit board layer set 104*b* covers the second surface, the back side, of the die 102 second surface, opposite the first surface, of the printhead die 102. Printhead structure 100 is then released from barrier 138, as shown in FIG. 10 (operation 1212 of FIG. 12).

Figure 11:
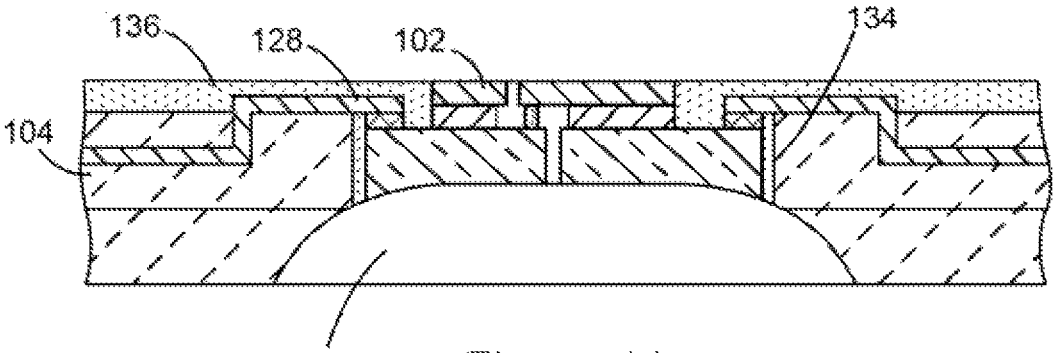
Figure 12:
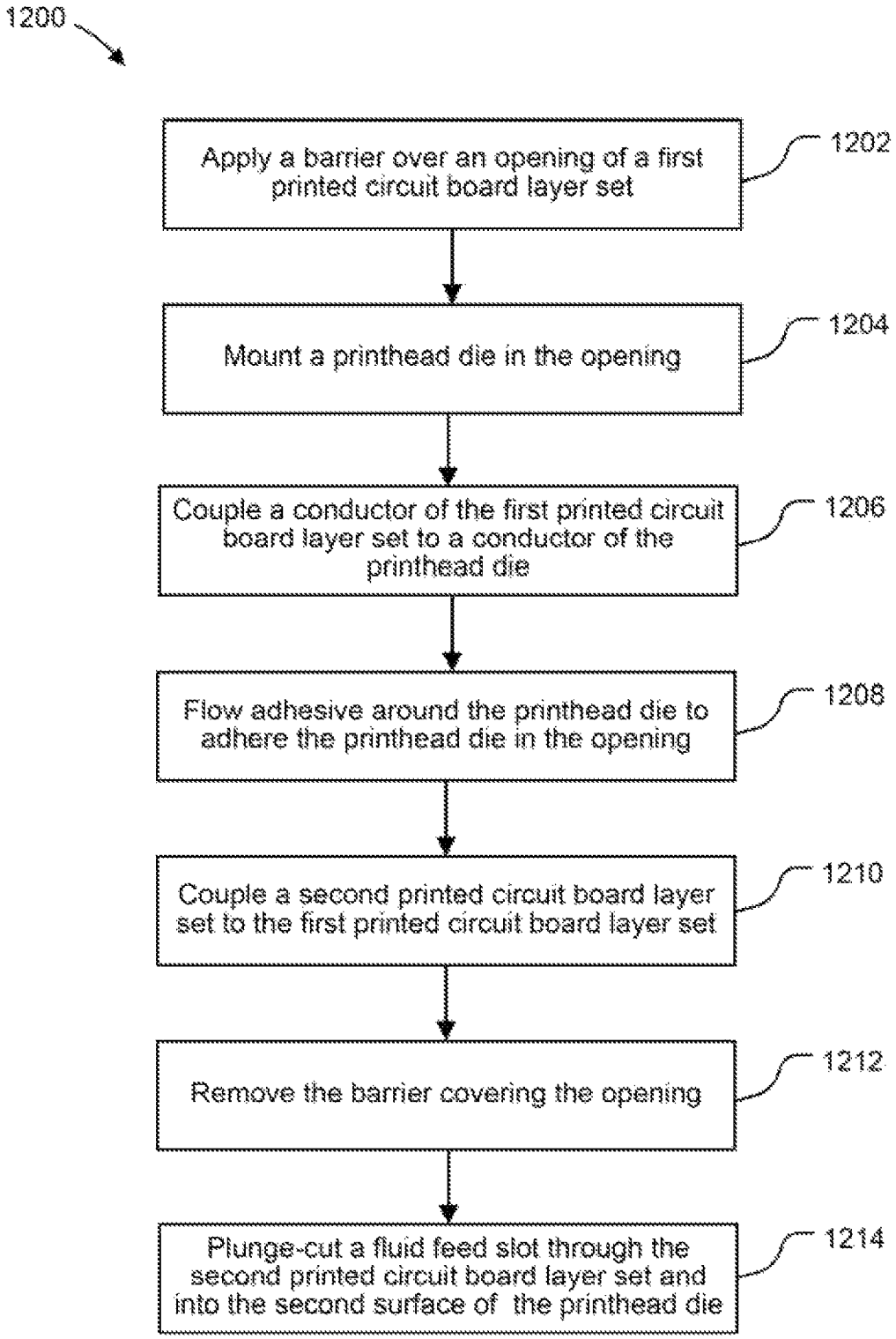

In FIG. 11, a fluid feed slot 114 is plunge-cut through the second printed circuit board layer set 104*b* and into the second surface of the die 102, as shown (operation 1214 of FIG. 12). In at least some implementations, forming fluid feed slot 114 after the die 102 is coupled to the printed circuit board 104*a*/104*b* may provide a more mechanically robust structure into which fluid feed slot 114 may be formed as compared to forming fluid feed slot 114 into a die without a printed circuit board 104*a*/104*b*, which may result in fewer cracks during the formation of the fluid feed slot 114. In addition, handling of the die 102 may be facilitated by coupling the die 102 to the larger footprint printed circuit board 104*a*/104*b*.

FIGS. 13-17 and 18-22 illustrate other examples in which electrical connections between the printed circuit board 104 and the die 102 (operation 1206 of FIG. 11) may be made after the printhead dies 102 are embedded in printed circuit board 14 to conductors 128 exposed on the exterior of printed circuit board 104 adjacent to the opening 134. For example, in various implementations, electrical connections between the printed circuit board 104 and the die 102 (operation 1206 of FIG. 11) may be performed after die attach adhesive 136 is flowed into the gaps around printhead die 102 (operation 1208 of FIG. 12) or after the second printed circuit board layer set 104*b* is coupled to the first printed circuit board layer set 104*b* (operation 1210 of FIG. 12). In some implementations, electrical connections between the printed circuit board 104 and the die 102 (operation 1206 of FIG. 11) may be performed after fluid feed slot 114 is plunge-cut through the second printed circuit board layer set 104*b* and into the second surface of the die 102, as shown (operation 1214 of FIG. 12).

Figure 13:
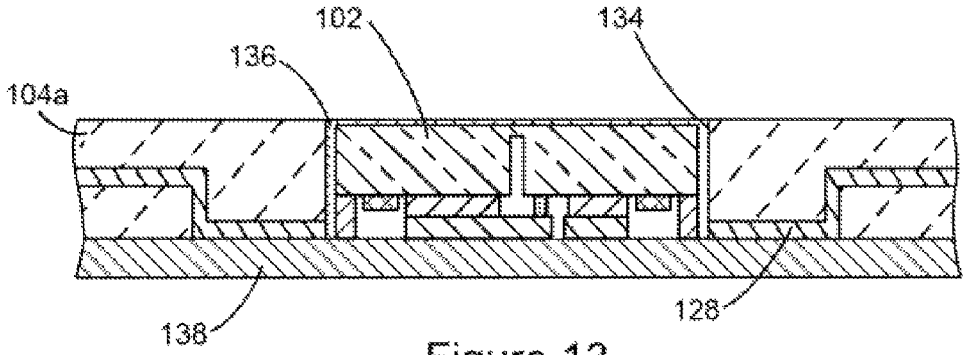
FIGS. 13-17 illustrate another example of a method for making a fluid ejection apparatus.

As shown in FIG. 13, a barrier 138 spanning the opening 134 in the first printed circuit board layer set 104*a* may form a cavity for receiving a printhead die 102 such that a first surface, the top side, of the die 102 faces the barrier 138 and a second surface, the back side, of the die 102 faces away from the barrier 138. In this example, the first printed circuit board layer set 104*a* may be a pre-impregnated ("pre-preg") with an epoxy resin or other suitable adhesive. The assembly may then be heated to flow pre-preg adhesive 136 into the gaps around printhead die 102 to couple printhead die 102 in the opening 134.

Figure 14:
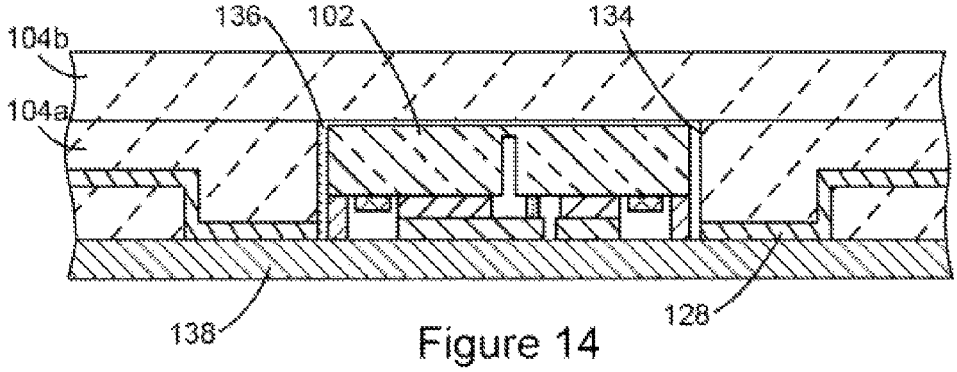
Figure 15:
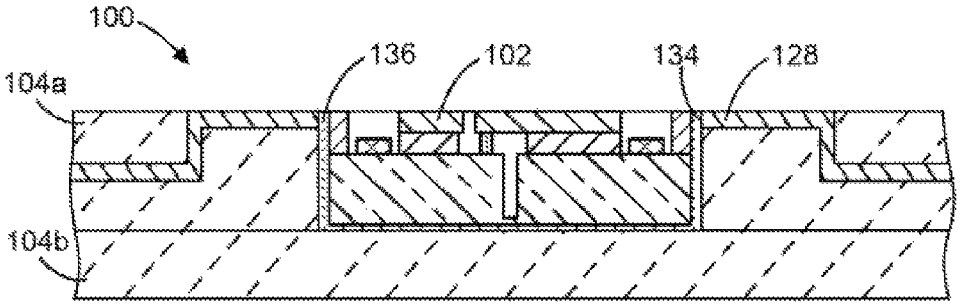

In FIG. 14, a second printed circuit board layer set 104*b* is coupled to the first printed circuit board layer set 104*b*. As shown, the second printed circuit board layer set 104*b* covers the second surface, the back side, of the die 102 second surface, opposite the first surface, of the printhead die 102. Printhead structure 100 is then released from barrier 138, as shown in FIG. 15.

Figure 16:
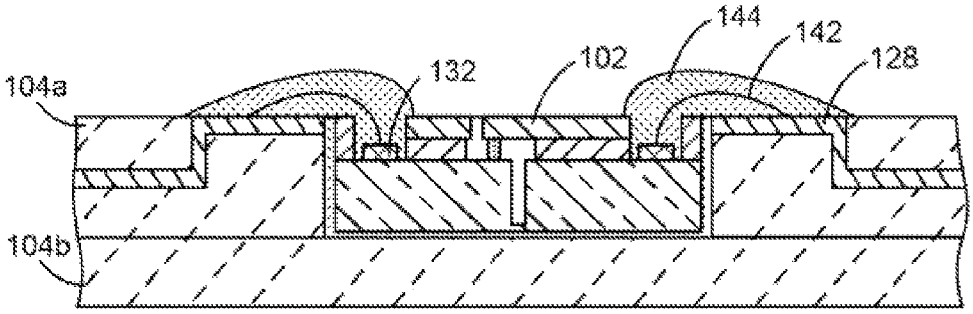

In FIG. 16, wires 142 are bonded to conductors 128 on the printed circuit board 104*a*/104*b* and the connections encapsulated in an encapsulate material 144.

Figure 17:
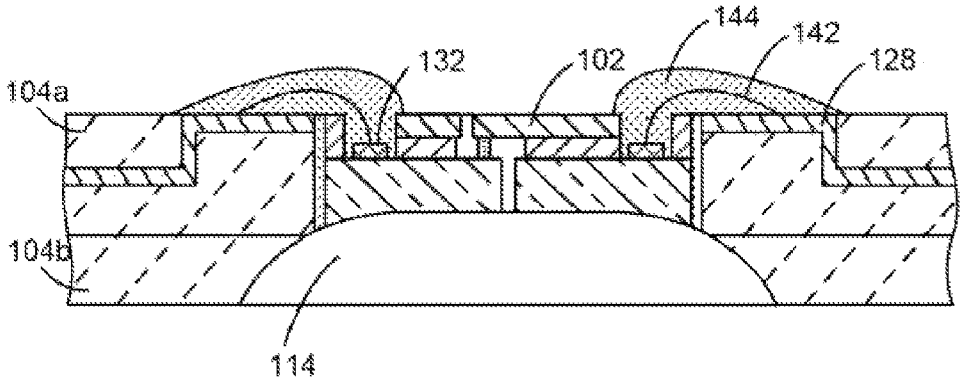

In FIG. 17, a fluid feed slot 114 is plunge-cut through the second printed circuit board layer set 104*b* and into the second surface of the die 102, as shown.

Figure 18:
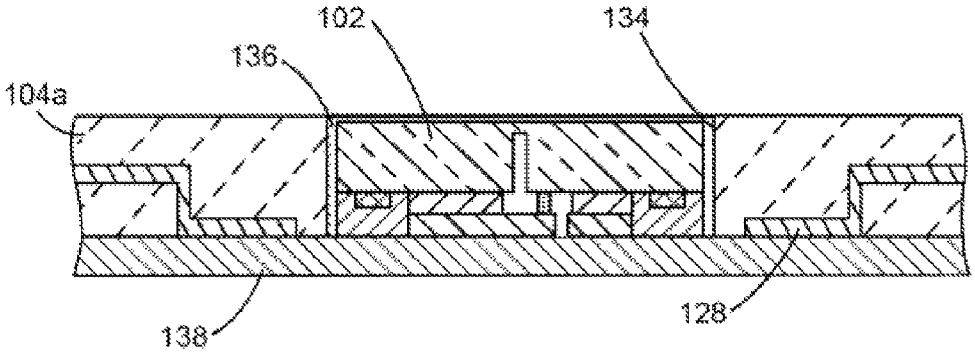
FIGS. 18-22 illustrate another example of a method for making a fluid ejection apparatus.

FIGS. 18-22 show another example for electrically coupling printed circuit board 104*a*/104*b* with printhead die 102. As shown in FIG. 18, a barrier 138 spanning the opening 134 in the first printed circuit board layer set 104*a* may form a cavity for receiving a printhead die 102 such that a first surface, the top side, of the die 102 faces the barrier 138 and a second surface, the back side, of the die 102 faces away from the barrier 138. The first printed circuit board layer set 104*a* may be a pre-preg with an epoxy resin or other suitable adhesive. The assembly may then be heated to flow pre-preg adhesive 136 into the gaps around printhead die 102 to couple printhead die 102 in the opening 134, as shown.

Figure 19:
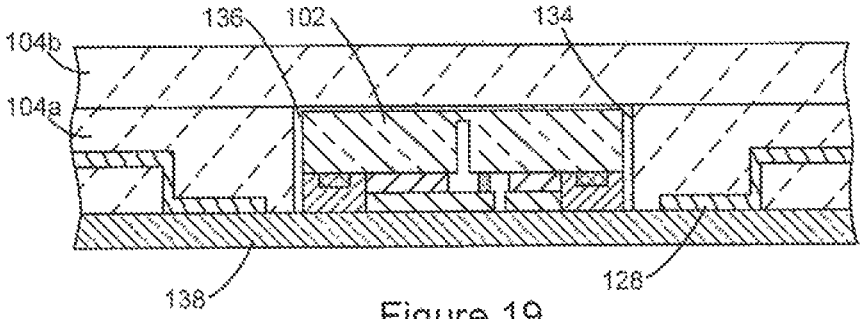
Figure 20:
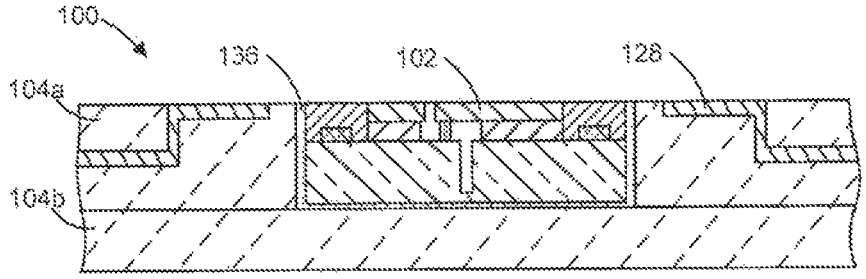

In FIG. 19, a second printed circuit board layer set 104*b* is coupled to the first printed circuit board layer set 104*b*. As shown, the second printed circuit board layer set 104*b* covers the second surface, the back side, of the die 102 second surface, opposite the first surface, of the printhead die 102. Printhead structure 100 is then released from barrier 138, as shown in FIG. 20.

Figure 21:
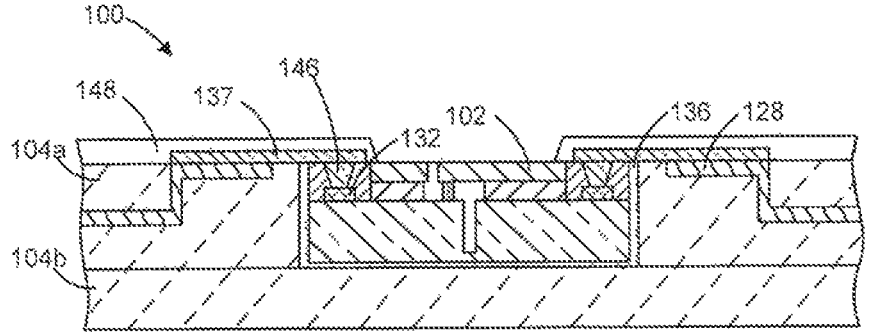
Figure 22:
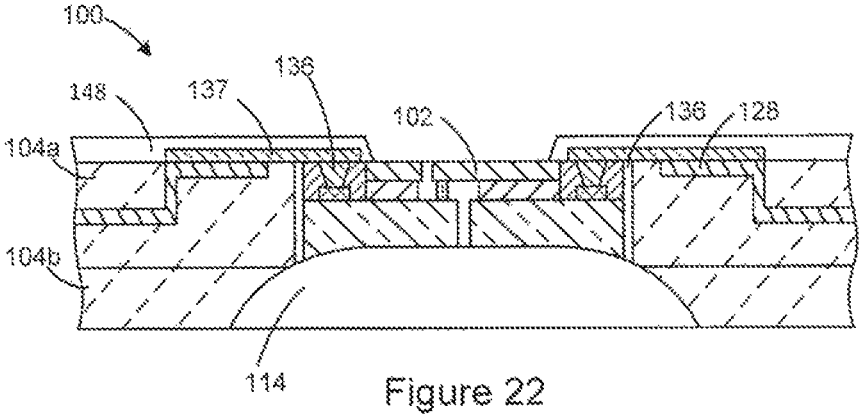

In FIG. 21, a metal trace layer may 137 be formed over the printed circuit board 104*a*/104*b* to electrically couple conductors 128 on the printed circuit board 104*a*/104*b* with the electrical terminals 132 of the printhead die 102. As shown, the printhead die 102 may include a conductive via 146 to electrically interconnect conductors 128 with the electrical terminals 132. In various implementations, a protective layer 148 may be laminated or deposited over at least a portion of the structure 100.

For the various implementations described herein, a printed circuit board fluid ejection apparatus 100 may enable the use of long, narrow and very thin printhead dies 102. For example, a 100 μm thick printhead die 102 that is about 28 mm long and 500 μm wide can be embedded in a 1 mm thick printed circuit board 104 to replace a conventional 500 μm thick silicon printhead die. Not only is it cheaper and easier to form plunge-cut ink slots 114 in a printed circuit board compared to forming feed channels/slots in a silicon substrate, but it is also cheaper and easier to form printing fluid ports 112 in a thinner die 102. For example, ports 112 in a 100 μm thick printhead die 102 may be formed by dry etching and other suitable micromachining techniques not practical for thicker substrates. Micromachining a high density array of through ports 112 in a thin silicon, glass or other substrate rather than forming conventional slots leaves a stronger substrate while still providing adequate printing fluid flow.

Various aspects of the illustrative embodiments are described herein using terms commonly employed by those skilled in the art to convey the substance of their work to others skilled in the art. It will be apparent to those skilled in the art that alternate embodiments may be practiced with only some of the described aspects. For purposes of explanation, specific numbers, materials, and configurations are set forth in order to provide a thorough understanding of the illustrative embodiments. It will be apparent to one skilled in the art that alternate embodiments may be practiced without the specific details. In other instances, well-known features are omitted or simplified in order not to obscure the illustrative embodiments.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of this disclosure. Those with skill in the art will readily appreciate that embodiments may be implemented in a wide variety of ways. This application is intended to cover any adaptations or variations of the embodiments discussed herein. It is manifestly intended, therefore, that embodiments be limited only by the claims and the equivalents thereof.

What is claimed is:

1. A fluid ejection apparatus comprising:

a printhead die having a first surface including at least one drop ejector, wherein the printhead die comprises a number of ports extending partially into the printhead die from the first surface without extending through to a second surface of the printhead die opposite the first surface;

a printed circuit board including the printhead die embedded in the printed circuit board such that the at least one drop ejector is exposed at a first surface of the printed circuit board, and a conductor coupled to a conductor on the printhead die; and a plunge-cut fluid feed slot through which fluid may flow to the printhead die, the plunge-cut fluid feed slot extending through a second surface, opposite the first surface, of the printed circuit board and into the second surface, opposite the first surface, of the printhead die exposing the number of ports formed therein.

2. The apparatus of claim 1, wherein the printhead die includes a fluid flow passage connected directly to the plunge-cut fluid feed slot.

3. The apparatus of claim 1, wherein the printhead die comprises a printhead die sliver disposed in an opening in the printed circuit board.

4. The apparatus of claim 1, wherein the printhead die comprises an arrangement of printhead die slivers each disposed in a corresponding opening in the board.

5. The apparatus of claim 1, wherein the conductor of the printed circuit board is coupled to the conductor of the printhead die by a wire bond.

6. The apparatus of claim 1, wherein the conductor of the printed circuit board is coupled to the conductor of the printhead die by an electrically conductive material.

7. The apparatus of claim 6, wherein the electrically conductive material comprises solder.

8. The apparatus of claim 1, wherein the conductor of the printed circuit board is electrically coupled to the conductor of the printhead die by a metal trace layer.

9. The fluid ejection apparatus of claim 1, wherein the printhead die further comprises at least one fluid chamber fluidically coupled to the at least one drop ejector from which a fluid is ejected into the at least one drop ejector.

10. The fluid ejection apparatus of claim 9, wherein the at least one chamber is fluidically coupled to the plunge-cut fluid feed slot.

11. A fluid ejection apparatus comprising:

a plurality of printhead dies comprising a number of fluid flow passages extending partially into a first surface of the printhead die without extending through to a second surface of the printhead die opposite the first surface;

a printed circuit board in which the plurality of printhead dies are mounted, the printed circuit board including conductors coupled to conductors of the printhead dies and a plurality of plunge-cut fluid feed slots through which fluid may flow to the printhead dies via the number of fluid flow passages when the plunge-cut is formed, each of the plunge-cut fluid feed slots extending into the printed circuit board and the printhead dies; and wherein the number of fluid flow passages fluidically couple each of the plurality of printhead dies with at least one of the plurality of plunge-cut fluid feed slots.

12. The apparatus of claim 11, wherein the printed circuit board comprises an elongated printed circuit board in which the printhead dies are mounted in openings in the printed circuit board and the printhead dies are arranged end to end along a length of the printed circuit board.

13. The fluid ejection apparatus of claim 11, wherein the plurality of printhead dies further comprise a plurality of fluid ejection chambers, each fluid ejection chamber fluidically coupled to a number of drop ejectors defined in a first surface of each of the printhead dies.

14. The fluid ejection apparatus of claim 13, wherein the plurality of printhead dies further comprise a number of ports fluidically coupled to each of the fluid ejection chambers to provide a fluidic channel between the fluid ejection chambers and the plunge-cut fluid feed slots.

15. A method for making a fluid ejection apparatus, comprising:

mounting a printhead die having a first surface including at least one drop ejector in an opening of a first printed circuit board layer set;

applying a barrier over the opening with the first surface of the printhead die against the barrier;

flowing adhesive around the printhead die to adhere the printhead die in the opening; and removing the barrier covering the opening;

coupling a second printed circuit board layer set to the first printed circuit board layer set to cover a second surface, opposite the first surface, of the printhead die;

after coupling the second printed circuit board layer set to the first printed circuit board layer set, plunge-cutting a fluid feed slot through the second printed circuit board layer set and into the second surface of the printhead die such that fluid may flow through the fluid feed slot to the printhead die; and coupling a conductor of the first printed circuit board layer set to a conductor of the printhead die;

wherein plunge-cutting the fluid feed slot through the second printed circuit board layer set and into the second surface of the printhead die opens a port defined in the printhead die to allow fluid to pass through the fluid feed slot and into the printhead die.

16. The method of claim 15, wherein said mounting the printhead die comprises mounting the printhead die including a substrate having at least one port fluidically coupled to the at least drop ejector, the at least one port extending partially into a substrate of the printhead die without extending through to the second surface of the printhead die.

17. The method of claim 16, wherein said plunge-cutting the fluid feed slot comprises plunge-cutting the fluid feed slot into the second surface of the printhead die to expose the at least one port such that fluid may flow through the fluid feed slot to the at least one drop ejector.

18. The method of claim 15, wherein the printhead die comprises a printhead die sliver.

19. The method of claim 15, wherein said coupling the conductor of the first printed circuit board layer set to the conductor of the printhead die comprises coupling the conductor of the first printed circuit board layer set to the conductor of the printhead die by a solder bond, a wire bond, or a metal trace layer.

20. The method of claim 15, wherein removing the barrier covering the opening is done before the second printed circuit board layer is coupled to the second surface of the printhead die.

* * * * *